United States Patent [19]

Park et al.

[11] Patent Number: 4,582,213

[45] Date of Patent: Apr. 15, 1986

[54] BEVERAGE CONTAINER WITH ENCLOSED STRAW

[76] Inventors: Sea C. Park; In P. Park, both of 3836 Birchwood, Skokie, Ill. 60076

[21] Appl. No.: 670,892

[22] Filed: Nov. 13, 1984

[51] Int. Cl.[4] ..... B65D 47/06

[52] U.S. Cl. ..... 220/90.2; 206/217; 229/75; 215/1 A

[58] Field of Search ..... 229/75; 200/217, 218; 220/90.4, 90.2, 70; 215/1 A

[56] References Cited

U.S. PATENT DOCUMENTS

| | | | |
|---|---|---|---|
| 3,946,895 | 3/1976 | Pugh | 229/75 |
| 4,194,674 | 3/1980 | Pearson | 229/75 |
| 4,226,356 | 10/1980 | Lemelson | 229/75 |
| 4,247,016 | 1/1981 | Shaw | 229/75 |
| 4,356,927 | 11/1982 | Cooper et al. | 229/75 |
| 4,407,425 | 10/1983 | Combs | 229/75 |
| 4,424,913 | 1/1984 | Ko | 229/75 |

*Primary Examiner*—Joseph Man-Fu Moy

*Attorney, Agent, or Firm*—Birch, Stewart, Kolasch & Birch

[57] ABSTRACT

The present invention comprises a sanitary beverage container having an enclosed straw which is automatically straightened and repositioned above the container when it is opened by pulling back the opening tab thereof. The straw is so positioned that the lips and the mouth do not contact the top or walls of the container while drinking the contents from the container, thereby avoiding contamination and bacteria frequently associated with the top and sides of the container.

8 Claims, 5 Drawing Figures

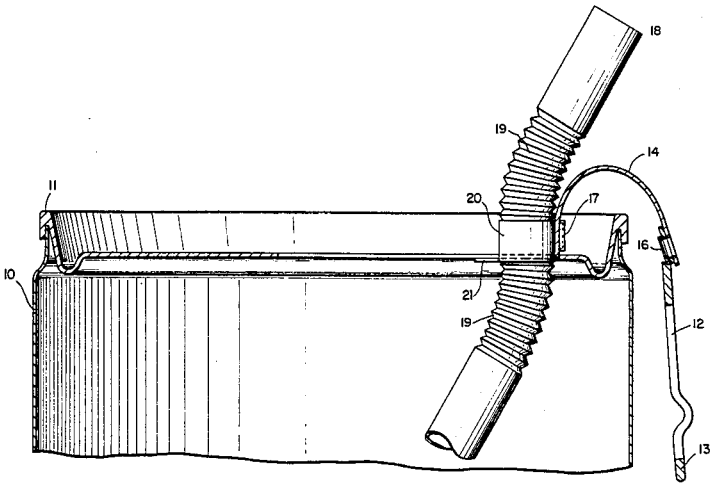

10
11
12
13
14
15
16
17
18
19
20
21

BEVERAGE CONTAINER WITH ENCLOSED STRAW

BACKGROUND OF THE INVENTION

The present invention relates to a sanitary beverage container with an enclosed straw and more particularly to an improved beverage container wherein upon opening the container, the straw is automatically relocated to a drinking position outside of the container.

Straws or tubes which are enclosed in beverage containers containing carbonated or non-carbonated drinks have been developed whereby an enclosed straw pops out of a container when it is opened. For example, in U.S. Pat. No. 3,656,654 and U.S. Pat. No. 4,247,016, the straws utilized therein have multiple bends in order to cause them to pop up as soon as the container is opened. Also the straws are of sufficient length to enable the user to avoid touching the container with the mouth. However, it is unreasonable to expect that the straws will pop up automatically when opening the container even though they are sometimes secured to a tear-out strip or overlay sheet, disposed on the top of the container.

U.S. Pat. No. 4,226,356 discloses a liquid container having a straw disposed therein which pops up by itself due to its bending power when the container is opened. But some difficulty is experienced in making the straw become straight because of a weakening of its bending power while being held in the container. In such a case, an unsanitary use of the fingers is sometimes required to adjust the position of the straw over the top of the container. In another example of the prior art U.S. Pat. No. 4,462,503 provides a beverage container with an enclosed straw and including a retainer and a spring stiffener. There are many disadvantages in this container including high manufacturing costs because of a complicated structure and great difficulty in maintaining the form of the straw.

SUMMARY AND OBJECTS OF THE INVENTION

Accordingly, it is an object of the present invention to provide a beverage container with an enclosed straw which can be used for drinking a beverage such as milk, soft drinks, juice and the like.

Another object of the present invention is to provide a beverage container with an enclosed straw which automatically pops up when the container is opened.

Still another object of the present invention is to provide a sanitary beverage container containing a straw whereby the straw can be utilized without contacting the mouth with the outside surface of the container.

Yet another object of the present invention is to provide a beverage container with a straw which is very easy and simple to use.

It is a further object of the present invention to provide a container having an enclosed straw which is economical and simple to manufacture as compared to conventional containers with enclosed straw.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention comprises a sanitary beverage container provided with an enclosed straw which is automatically straightened and repositioned above the container when it is opened by pulling back the opening tab. The straw is so positioned that the lips and the mouth do not contact the top or walls of the container while drinking the contents from the container.

BRIEF DESCRIPTION OF THE INVENTION

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
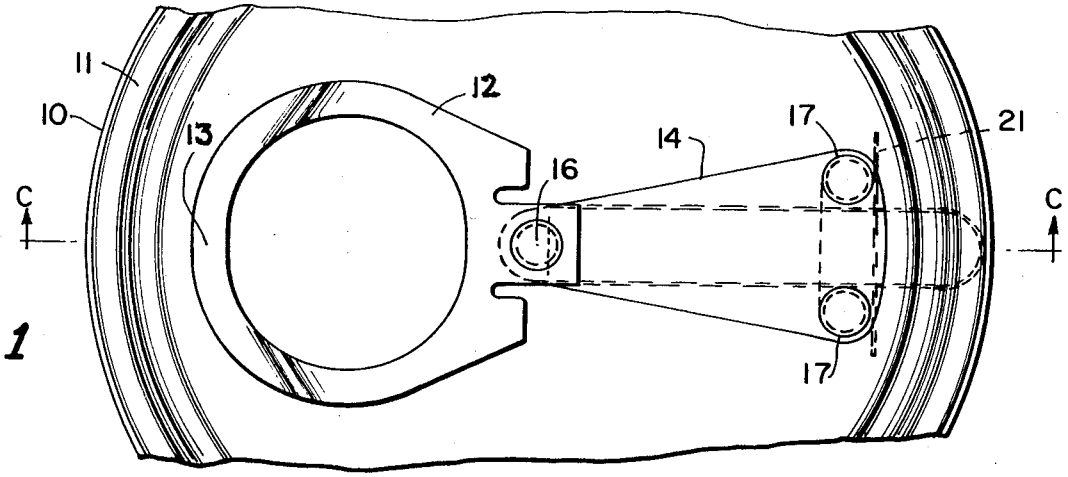
FIG. 1 is a top view of the beverage container with an enclosed straw according to the present invention.
Figure 2:
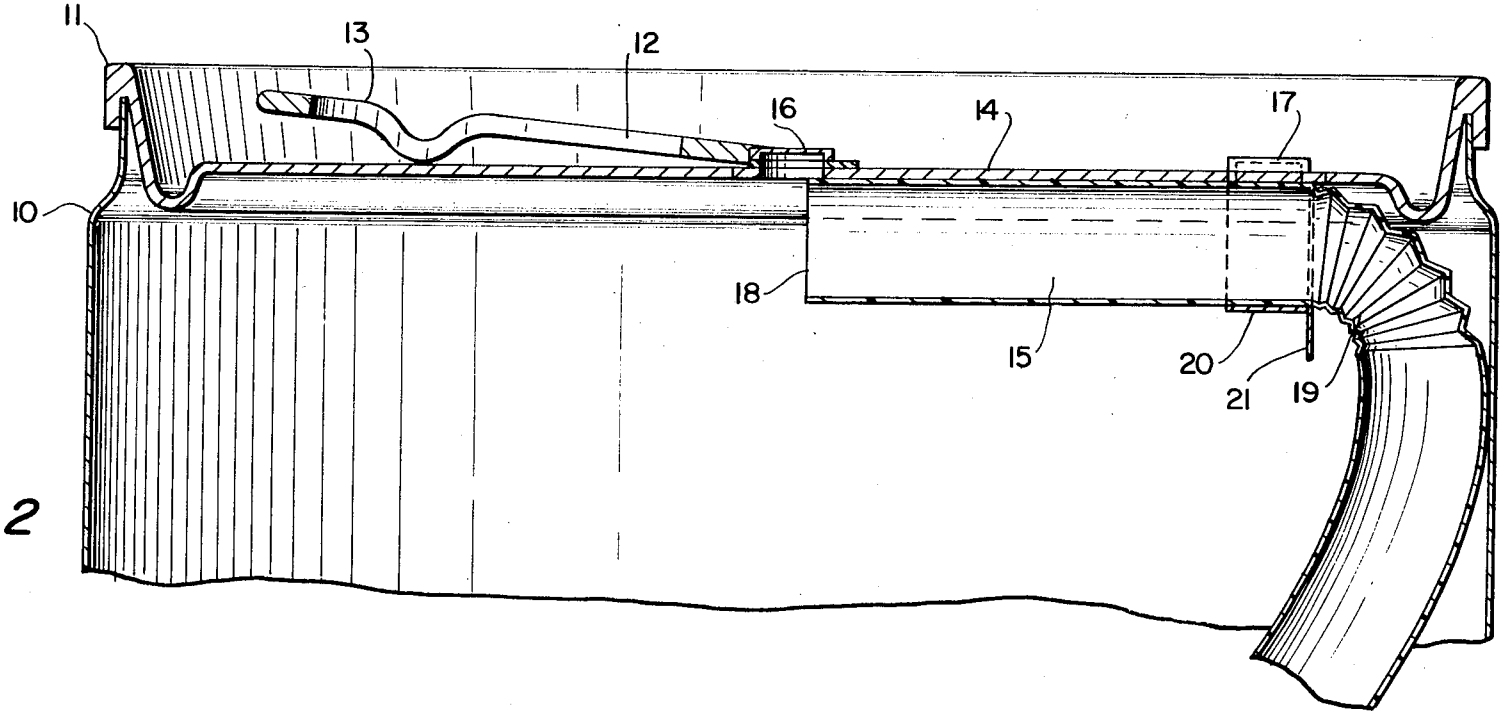
FIG. 2 is a cross-sectional view of upper portion of the beverage container with an enclosed straw taken along the line c—c of FIG. 1.

Referring now in detail to the drawing for the purpose of illustrating the present invention, the beverage container 10 of the present invention as shown in FIGS. 1 and 2, comprises a top wall 11, an opening tab 12 having a finger opening 13, a removable panel 14, and a straw 15 attached to the panel 14 by a convex rivet 17.

Figures 3, 3A:
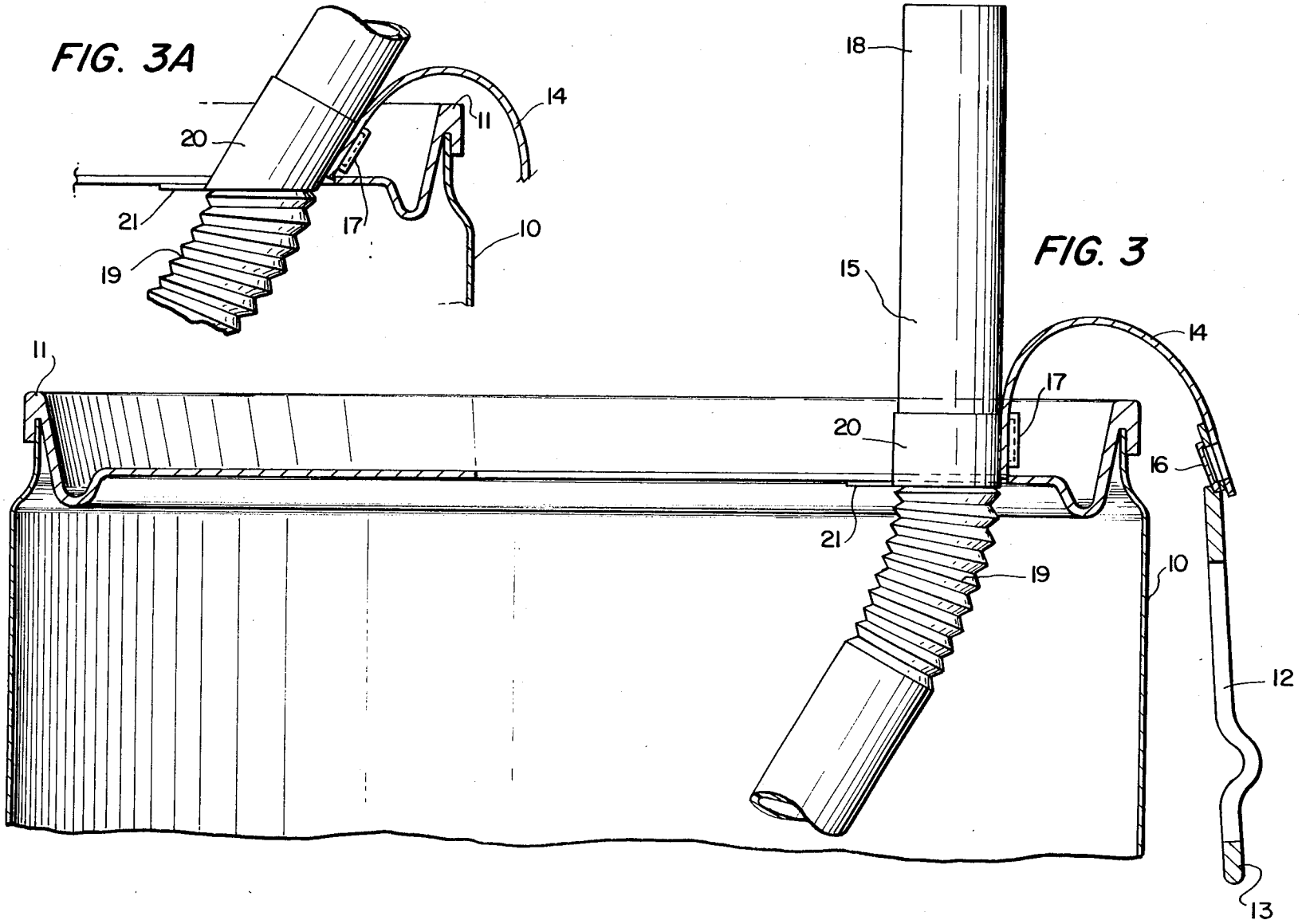
FIG. 3 is a cross-sectional view of the beverage container with an enclosed straw showing the straw in its drinking position according to the present invention.
FIG. 3A is a cross-sectional view of another drinking position of the straw according to the present invention.
Figure 4:
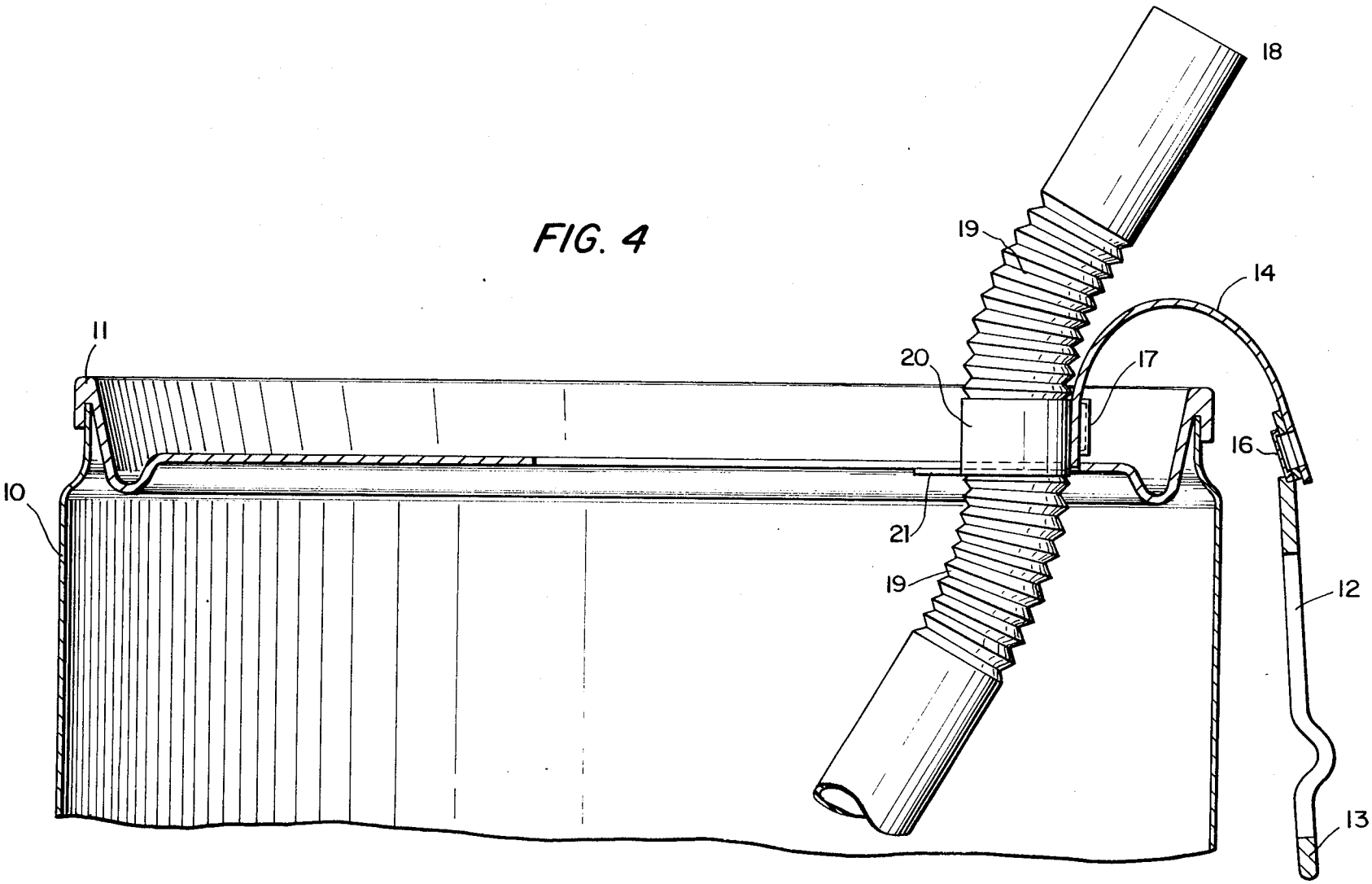
FIG. 4 is a cross-sectional view of another type of straw drinking arrangement according to the present invention.

The front portion of the removable panel 14 is attached to the finger opening 13 by a front rivet 16 which extends from the top wall 11 of the container 10. The straw 15 as shown in FIGS. 3, 3A and 4, comprises a mouthpiece portion 18 which is adapted to contact the mouth of the user and an oppositely disposed lower end portion (not shown) extending to the inner bottom wall of the container 10. Bending portions 19 are disposed above and below the top of the container. The straw is also provided with a sleeve 20 which fixes the straw to the removal panel 14. The sleeve is provided with a plate 21 for engagement with the inside surface of the lid for determining the position of the straw as it extends above the top of the container.

When the container 10 is opened by pulling the finger opening 13 upwardly, as shown in FIGS. 3 and 4, the straw 15 is automatically repositioned from within the container to a drinking position above the container. As the removable panel is peeled back, the straw emerges from the container, with the mouthpiece 18 separating from the removable panel 14 and the front rivet 16. However, the removable panel 14 remains connected to sleeve 20 by the convex rivet 17 so that the sleeve can be repositioned by the container opening operation.

The straw can be made to stand obliquely as shown in FIGS. 3A or 4 for easy drinking by either providing a second corrugated bending portion or by redesigning the sleeve 20 and flanges 21 as specifically shown in FIG. 3A. When the flange extends from the sleeve at an angle of about 90°, the drinking end of the straw can be repositioned in a substantially vertical position above the container as shown in FIG. 3. When the flange extends from the sleeve at an angle greater than 90°, the drinking end of the straw can be repositioned in a canted position above the container. The present drinking device is more sanitary than conventional beverage containers having an enclosed straw or tube because the opening tab 12 can be pulled back and down along the container so that the lips or mouth of the user never contacts the outside surface of the container. That is, the lips of user only contacts the inner surface of the removable panel 14.

Additionally, it is easy and simple to throw away the waste container which contains the opening tab 12 and the straw 15 attached thereto.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed:

1. A sanitary lid-drinking straw combination forming a part of a beverage container which comprises:

a container top containing a removable panel portion, an opener attached to the outside surface of the lid at one end of the removable panel, and a drinking straw attached to the inside surface of the removable panel portion and extending along the inside surface of the panel portion, said drinking straw being provided with a sleeve to which the removable panel is fixedly attached to said sleeve containing a flange which extends therefrom, whereupon by peeling back the removable panel with the opener the flange engages the inside surface of the top of the container, the end of the drinking straw is released from the container to extend above the surface thereof, and the removable panel is extended away from the straw to provide a contamination-free surface for contact by the mouth of the user.

2. The sanitary lid-drinking straw combination of claim 1 wherein the flange extends from the sleeve at an angle of about 90° which positions the drinking lid of the drinking straw in a substantially vertical position above the container.

3. The sanitary lid-drinking straw combination of claim 1, wherein the flange extends from the sleeve of an angle of greater than 90° which positions the drinking end of the drinking straw in a canted position above the container.

4. The sanitary lid-drinking straw combination of claim 1, wherein the drinking straw is provided with a bending portion below the top of the container.

5. The sanitary lid-drinking straw combination of claim 1, wherein the drinking straw is provided with an additional bending portion above the top of the container.

6. The sanitary lid-drinking straw combination of claim 1, wherein the opener is a pull ring.

7. The sanitary lid-drinking straw combination of claim 1, wherein the pull ring is securely attached to the removable panel.

8. The sanitary lid-drinking straw combination of claim 1, wherein the sanitary lid has a pop-top configuration.

* * * * *